US010176740B2

(12) United States Patent
Park et al.

(10) Patent No.: US 10,176,740 B2
(45) Date of Patent: Jan. 8, 2019

(54) DISPLAY DEVICE

(71) Applicant: Samsung Display Co., Ltd., Yongin-si Gyeonggi-do (KR)

(72) Inventors: Yongdoo Park, Jeonju-si (KR); Keun-tae Jung, Yongin-si (KR); Heejune Kwak, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 433 days.

(21) Appl. No.: 14/951,396

(22) Filed: Nov. 24, 2015

(65) Prior Publication Data

US 2016/0275903 A1 Sep. 22, 2016

(30) Foreign Application Priority Data

Mar. 19, 2015 (KR) ..... 10-2015-0038417

(51) Int. Cl.
*G09G 3/20* (2006.01)

(52) U.S. Cl.
CPC ..... *G09G 3/20* (2013.01); *G09G 2300/0426* (2013.01); *G09G 2310/0213* (2013.01); *G09G 2310/06* (2013.01); *G09G 2310/067* (2013.01); *G09G 2310/08* (2013.01); *G09G 2330/021* (2013.01)

(58) Field of Classification Search
CPC ..... G09G 3/20; G09G 3/3696; G09G 5/00; G09G 5/02
USPC ..... 345/87, 212, 690
See application file for complete search history.

(56) References Cited

U.S. PATENT DOCUMENTS 7,940,346 B2 * 5/2011 You ..... G02F 1/13624 349/144
2009/0009510 A1 * 1/2009 Shu ..... G09G 3/3688 345/215
2014/0062331 A1 * 3/2014 Nam ..... G09G 3/3233 315/226
2014/0160182 A1 * 6/2014 Hong ..... G09G 3/3696 345/691

(Continued)

FOREIGN PATENT DOCUMENTS

KR 10-0486254 B1 5/2005
KR 10-2007-0040172 A 4/2007

(Continued)

OTHER PUBLICATIONS

Abstract (Machine Translation) for KR 10-2004-0017157 which corresponds to KR 10-0486254 B1 Listed Above, 2 pages.

*Primary Examiner* — Calvin C Ma
(74) *Attorney, Agent, or Firm* — Lewis Roca Rothgerber Christie LLP

(57) ABSTRACT

Provided is a display device including a gate driver configured to output a plurality of gate signals to a plurality of gate lines during each of a first frame and a second frame, and a display panel configured to display a first image during the first frame and to display a second image during the second frame, the second frame being longer in duration than the first frame, wherein each of the gate signals includes a high interval having a first voltage level and a low interval having a second voltage level lower than the first voltage level, and wherein the second voltage level of the gate signals during the second frame is lower than the second voltage level of the gate signals during the first frame.

18 Claims, 8 Drawing Sheets

(56) References Cited

U.S. PATENT DOCUMENTS

2014/0313181 A1* 10/2014 Hong ..... G09G 3/3696
345/212

FOREIGN PATENT DOCUMENTS

| | | | |
|---|---|---|---|
| KR | 10-2009-0123804 | A | 12/2009 |
| KR | 10-2012-0018256 | A | 3/2012 |
| KR | 10-2012-0057426 | A | 6/2012 |
| KR | 10-2014-0076252 | A | 6/2014 |

* cited by examiner

FIG. 2

| Image Driving Mode | Image Control Signal | Frequency | Driving Control Signal | Gate-Off Voltage |
|---|---|---|---|---|
| P1 | I-CS1 | fn1 | P-CS1 | Voff1 |
| P2 | I-CS2 | fn2 | P-CS2 | Voff2 |

FIG. 5

| Image Driving Mode | Image Control Signal | Frequency | Driving Control Signal | Interval | Gate-Off Voltage |
|---|---|---|---|---|---|
| P2 | I-CS | fn | P-CS | t1 | Voff1 |
| | | | | t2 | Voff2 |
| | | | | t3 | Voff3 |

DISPLAY DEVICE

CROSS-REFERENCE TO RELATED APPLICATIONS

This patent application claims priority to and the benefit of Korean Patent Application No. 10-2015-0038417, filed on Mar. 19, 2015, the entire content of which is hereby incorporated by reference.

BACKGROUND

The present disclosure herein relates to a display device.

Recently, Video Electronics Standards Association (VESA) has published a new embedded DisplayPort (eDP) standard. The eDP standard is an interface standard corresponding to a DisplayPort interface designed for devices with a display, such as laptops, PCs, tablets, and the like. In particular, the eDP standard employs a panel self-refresh (PSR) technology. The PSR technology has been proposed to improve system power saving performance and extend a battery life in a portable PC environment. That is, according to the PSR technology, an image can be displayed with minimum power by using a memory installed in a display according to image signal information.

In order to reduce power consumption, a frequency of a vertical synchronization signal for initiating output of gate signals may be controlled. For example, in the case where image signal information is changed every frame, the vertical synchronization signal may have a normal frequency. On the contrary, in the case where the image signal information is not changed for at least a reference number of frames, the vertical synchronization signal may have a low frequency.

SUMMARY

Aspects of embodiments of the present disclosure are directed to a display device for controlling an output level of a gate-off voltage according to image signal information.

According to some embodiments of the present inventive concept, there is provided a display device including: a gate driver configured to output a plurality of gate signals to a plurality of gate lines during each of a first frame and a second frame; and a display panel configured to display a first image during the first frame and to display a second image during the second frame, the second frame being longer in duration than the first frame, wherein each of the gate signals includes a high interval having a first voltage level and a low interval having a second voltage level lower than the first voltage level, and wherein the second voltage level of the gate signals during the second frame is lower than the second voltage level of the gate signals during the first frame.

In an embodiment, each of the gate signals has a positive polarity in the high interval and has a negative polarity in the low interval.

In an embodiment, the first voltage level and the second voltage level have substantially the same magnitude.

In an embodiment, the display device further includes a signal controller configured to generate a driving control signal according to the first and second frames.

In an embodiment, the display device further includes a gate voltage generator configured to output, in response to the driving control signal, a first gate-off voltage or a second gate-off voltage lower than the first gate-off voltage to the gate driver.

In an embodiment, the gate driver is configured to output the gate signals having the second voltage level corresponding to the low interval of the first frame on a basis of the first gate-off voltage, and to output the gate signals having the second voltage level corresponding to the low interval of the second frame based on the second gate-off voltage.

In an embodiment, the gate signals of the first frame have a constant level during the low interval of the first frame, and the second voltage level of the gate signals of the second frame has a substantially constant level during the low interval of the second frame.

In an embodiment, the display panel includes a first display interval during which an image based on the first frame is displayed and a first blank interval during which an image is not displayed, and includes a second display interval during which an image based on the second frame is displayed, and a second blank interval.

In an embodiment, the first and second display intervals have substantially the same interval.

In an embodiment, the second blank interval is longer in duration than the first blank interval.

In an embodiment, the low interval of each of the gate signals is longer in duration than the high interval.

According to some embodiments of the present inventive concept, there is provided a display device including: a gate driver configured to output a plurality of gate signals to a plurality of gate lines during each of a first frame and a second frame; and a display panel configured to display a first image during the first frame and display a second image during the second frame, the second frame being longer in duration than the first frame, the second frame including a display interval during which the second image is displayed and a blank interval during which the second image is not displayed, wherein each of the gate signals of the first frame includes a first interval having a first voltage level and a second interval having a second voltage level lower than the first voltage level, wherein each of the gate signals of the second frame includes a third interval having the first voltage level and a fourth interval having a voltage level lower than the first voltage level, and wherein the fourth interval includes a first sub interval corresponding to the display interval and a second sub interval during which the gate signals are lower than the second voltage level in at least a part of the blank interval.

In an embodiment, each of the gate signals of the second frame has a third voltage level lower than the second voltage level during the first and second sub intervals.

In an embodiment, each of the gate signals of the second frame has the second voltage level during the first sub interval, and has a third voltage level lower than the second voltage level in at least a part of the second sub interval.

In an embodiment, each of the gate signals of the second frame has a fourth voltage level lower than the third voltage level in an other part of the second sub interval.

In an embodiment, each of the gate signals of the second frame has the second voltage level during the first sub interval, has the second voltage level in a part of the second sub interval, and has a third voltage level lower than the second voltage level in an other part of the second sub interval.

In an embodiment, the first and third intervals have substantially the same length.

In an embodiment, the display panel further includes a display interval during which the first image based on the first frame is displayed and an other blank interval during which the first image is not displayed, and the blank interval of the second frame is longer in duration than the other blank interval of the first frame.

BRIEF DESCRIPTION OF THE FIGURES

The accompanying drawings are included to provide a further understanding of the present inventive concept, and are incorporated in and constitute a part of this specification. The drawings illustrate exemplary embodiments of the present inventive concept and, together with the description, serve to explain principles of the present inventive concept. In the drawings:

FIG. 2 is a table illustrating a change of a gate-off voltage depending on image signal information, according to an embodiment of the present inventive concept;

FIG. 5 is a table illustrating a change of a gate-off voltage depending on image signal information, according to another embodiment of the present inventive concept.

DETAILED DESCRIPTION

Figure 1:
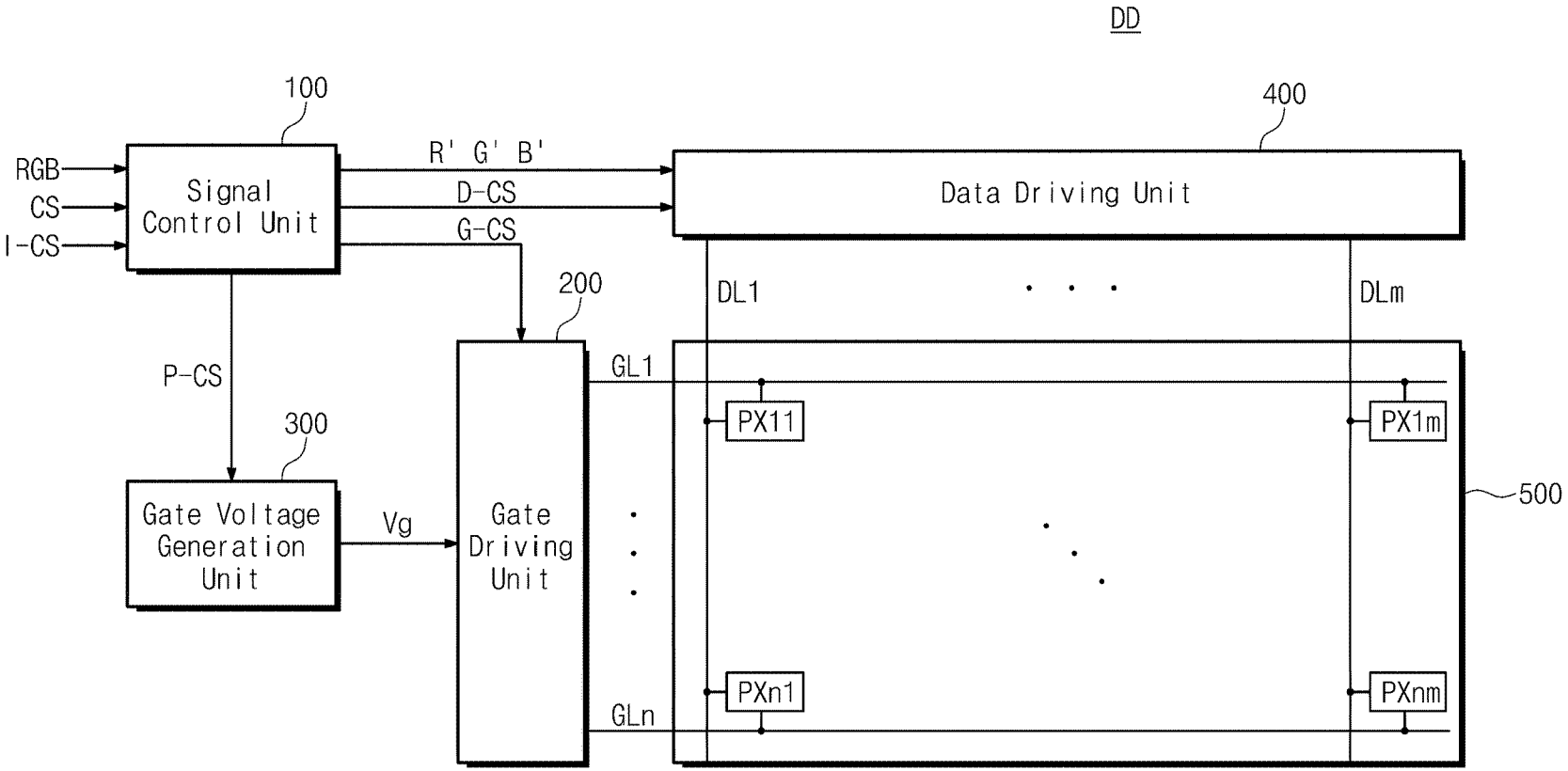
FIG. 1 is a block diagram illustrating a display device according to an embodiment of the present inventive concept.

Exemplary embodiments of the present inventive concept will be described below in more detail with reference to the accompanying drawings. The present inventive concept may, however, be embodied in different forms and should not be construed as limited to the embodiments set forth herein. Rather, these embodiments are provided so that this disclosure will be thorough and complete, and will fully convey the scope of the present inventive concept to those skilled in the art.

Like reference numerals refer to like elements throughout the description. In the drawings, the dimensions of structures are exaggerated or reduced for clarity of illustration.

FIG. 1 is a block diagram illustrating a display device according to an embodiment of the present inventive concept.

Referring to FIG. 1, a display device DD includes a signal control unit (e.g., a signal controller) 100, a gate driving unit (e.g., a gate driver) 200, a gate voltage generation unit (e.g., a gate voltage generator) 300, a data driving unit (e.g., a data driver) 400, and a display panel 500.

The signal control unit 100 receives, from the outside of the display device, a plurality of image signals RGB corresponding to a plurality of frames, a plurality of control signals CS, and an image control signal I-CS. The signal control unit 100 converts a data format of the image signals RGB so that the image signals RGB are compatible with an interface with the data driving unit 400. Data-format-converted image signals R'G'B' are provided to the data driving unit 400.

According to an embodiment of the present inventive concept, the signal control unit 100 may control, in response to the image control signal I-CS, a low interval of a plurality of gate signals output from the gate driving unit 200. According to an embodiment of the present inventive concept, each gate signal includes a high interval having a first voltage level and a low interval having a second voltage level. Pixels PX11 to PXnm may be scanned in response to the gate signals having the first voltage level.

For example, in the case where the signal control unit 100 receives the image control signal I-CS having a low level, the signal control unit 100 determines that different images are continuously displayed. That is, if image signals corresponding to two or more successive frames are different from each other, the image control signal I-CS having a low level is provided to the signal control unit 100. In this case, the display panel 500 displays an image of a first frame according to the image control signal I-CS having a low level. The signal control unit 100 controls the display panel 500 so that the display panel 500 is driven normally at a driving frequency, in response to the image control signal I-CS having a low level.

On the contrary, in the case where the signal control unit 100 receives the image control signal I-CS having a high level, the signal control unit 100 determines that an image is still (e.g., unchanging). That is, if image signals corresponding to two or more successive frames are the same, the image control signal I-CS having a high level is provided to the signal control unit 100. In this case, the display panel 500 displays an image of a second frame according to the image control signal I-CS having a high level. The signal control unit 100 controls the display panel 500 so that the display panel 500 is driven at a low frequency, in response to the image control signal I-CS having a high level. Here, it is assumed that the display device DD displays one image for one frame.

According to an embodiment of the present inventive concept, a time for (e.g., a duration of) the second frame is set to be longer than that for the first frame. The first frame is described as a normal frame with a driving frequency, and the second frame is described as a low-frequency frame below. The display panel 500 may display one image for each of the first and second frames.

The signal control unit 100 may output a plurality of driving signals in response to the control signals CS. The signal control unit 100 may generate a data driving signal D-CS and a gate driving signal G-CS as the plurality of driving signals. For example, the data driving signal D-CS may include an output initiation signal and a horizontal initiation signal. The gate driving signal G-CS may include a vertical initiation signal and a vertical clock bar signal. The signal control unit 100 transfers the data driving signal D-CS to the data driving unit 400, and transfers the gate driving signal G-CS to the gate driving unit 200.

Furthermore, according to an embodiment of the present inventive concept, the signal control unit 100 may generate a driving control signal P-CS for controlling a gate control voltage Vg on the basis of a normal frame or a low-frequency frame. The signal control unit 100 transfer the driving control signal P-CS to the gate voltage generation unit 300. This operation will be described in more detail with reference to FIGS. 2 to 8.

The gate driving unit 200 generates a plurality of gate signals in response to the gate driving signal G-CS provided from the signal control unit 100. The gate driving unit 200 sequentially outputs the gate signals to the display panel 500 through a plurality of gate lines GL1 to GLn. A plurality of pixels PX11 to PXnm included in the display panel 500 may be scanned sequentially and on a per-row basis (e.g., may the rows may be sequentially scanned).

The gate driving unit 200 outputs the gate signals having a high level to respective gate lines in response to the gate control signal G-CS, so that the pixels PX11 to PXnm are scanned. Furthermore, the gate driving unit 200 outputs the gate signals having a low level to respective gate lines for transition of the high level. For example, the gate driving unit 200 may be implemented in the form of an amorphous silicon TFT gate (ASG) driver circuit or an oxide semiconductor TFT gate (OSG) driver circuit.

The gate voltage generation unit 300 generates the gate control voltage Vg in response to the driving control signal P-CS provided from the signal control unit 100. According to an embodiment of the present inventive concept, the gate control voltage Vg may be used so that the gate signals provided to the gate lines GL1 to GLn are changed in level from a high level to a low level. The gate voltage generation unit 300 provides the gate control voltage Vg to the gate driving unit 200. That is, the gate driving unit 300 outputs the gate control voltage Vg to the gate lines as the gate signals having a low level.

However, the present inventive concept is not limited thereto. That is, the gate voltage generation unit 300 may further generate a high-level gate control voltage to be used so that the gate signals provided to the gate lines GL1 to GLn are changed in level from a low level to a high level. Herein, it is assumed that the gate control voltage Vg is a gate-off voltage used so that the gate signals provided to the gate lines GL1 to GLn transition from a high level to a low level.

The data driving unit 400 converts the plurality of image signals R'G'B' into a plurality of data voltages in response to the data driving signal D-CS provided from the signal control unit 100. The data driving unit 400 outputs the data voltages to the display panel 500 through a plurality of data lines DL1 to DLm.

The display panel 500 includes the gate lines GL1 to GLn, the data lines DL1 to DLm, and the pixels PX11 to PXnm.

The gate lines GL1 to GLn extend in a row direction and cross the data lines DL1 to DLm extending in a column direction. The gate lines GL1 to GLn are electrically connected to the gate driving unit 200 to receive the gate signals. The data lines DL1 to DLm are electrically connected to the data driving unit 400 to receive the data voltages. The pixels PX11 to PXnm are connected to corresponding gate lines GLn and corresponding data lines DLm.

FIG. 2 is a table illustrating a change of a gate-off voltage depending on image signal information, according to an embodiment of the present inventive concept.

Referring to FIGS. 1 and 2, the display device DD is operated in a first image driving mode P1 or a second image driving mode P2 according to the image control signal I-CS. Herein, it is assumed that operation for the above-mentioned normal frame is performed in the first image driving mode P1 and operation for the above-mentioned low-frequency frame is performed in the second image driving mode P2.

In further detail, the signal control unit 100 controls the display panel 500 on the basis of a normal frame with a driving frequency in response to a first image control signal I-CS1. In this case, the signal control unit 100 outputs a first driving control signal P-CS1 to the gate voltage generation unit 300 in response to the first image control signal I-CS1. Here, the first driving control signal P-CS1 may be generated on the basis of a normal frame corresponding to a first frequency fn1. The gate voltage generation unit 300 outputs a first gate-off voltage Voff1 to the gate driving unit 200 in response to the first driving control signal P-CS1.

That is, the gate driving unit 200 provides the first gate-off voltage Voff1 to the gate lines GL1 to GLn so that each gate signal transitions from a high level to a low level. As a result, because the first gate-off voltage Voff1 is provided from the gate driving unit 200 to the gate lines GL1 to GLn, the pixels PX11 to PXnm are not operated (e.g., are not electrically driven).

Furthermore, the signal control unit 100 controls the display panel 500 on the basis of a low-frequency frame for which a time is set to be longer than that for a normal frame, in response to a second image control signal I-CS2. In this case, the signal control unit 100 outputs a second driving control signal P-CS2 to the gate voltage generation unit 300 in response to the second image control signal I-CS2. Here, the second driving control signal P-CS2 may be generated on the basis of a low-frequency frame corresponding to a second frequency fn2. The gate voltage generation unit 300 outputs a second gate-off voltage Voff2 to the gate driving unit 200 in response to the second driving control signal P-CS2.

That is, the gate driving unit 200 provides the second gate-off voltage Voff2 to the gate lines GL1 to GLn so that each gate signal transitions from a high level to a low level. As a result, because the second gate-off voltage Voff2 is provided from the gate driving unit 200 to the gate lines GL1 to GLn, the pixels PX11 to PXnm are not operated (e.g., are not electrically driven).

According to an embodiment of the present inventive concept, the first frequency fn1 may be set to be higher than the second frequency fn2. For example, the first frequency fn1 may be about two times higher than the second frequency fn2. If the first frequency fn1 is about 60 Hz, the second frequency fn2 may be about 30 Hz.

According to an embodiment of the present inventive concept, the second gate-off voltage Voff2 may be set to be lower than the first gate-off voltage Voff1.

Figure 3:
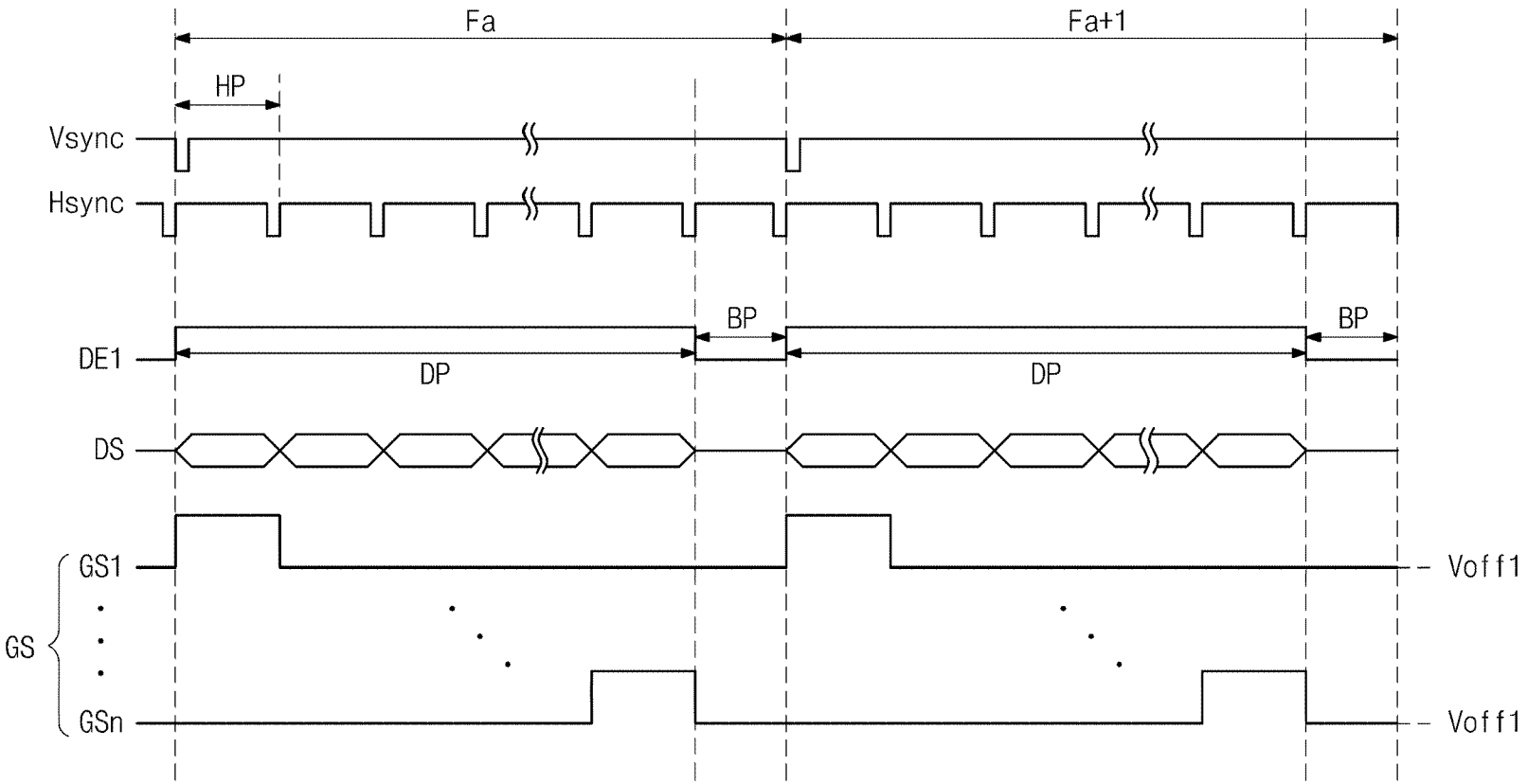
FIG. 3 is a timing diagram illustrating a gate-off voltage based on the first image driving mode illustrated in FIG. 2.
Figure 4:
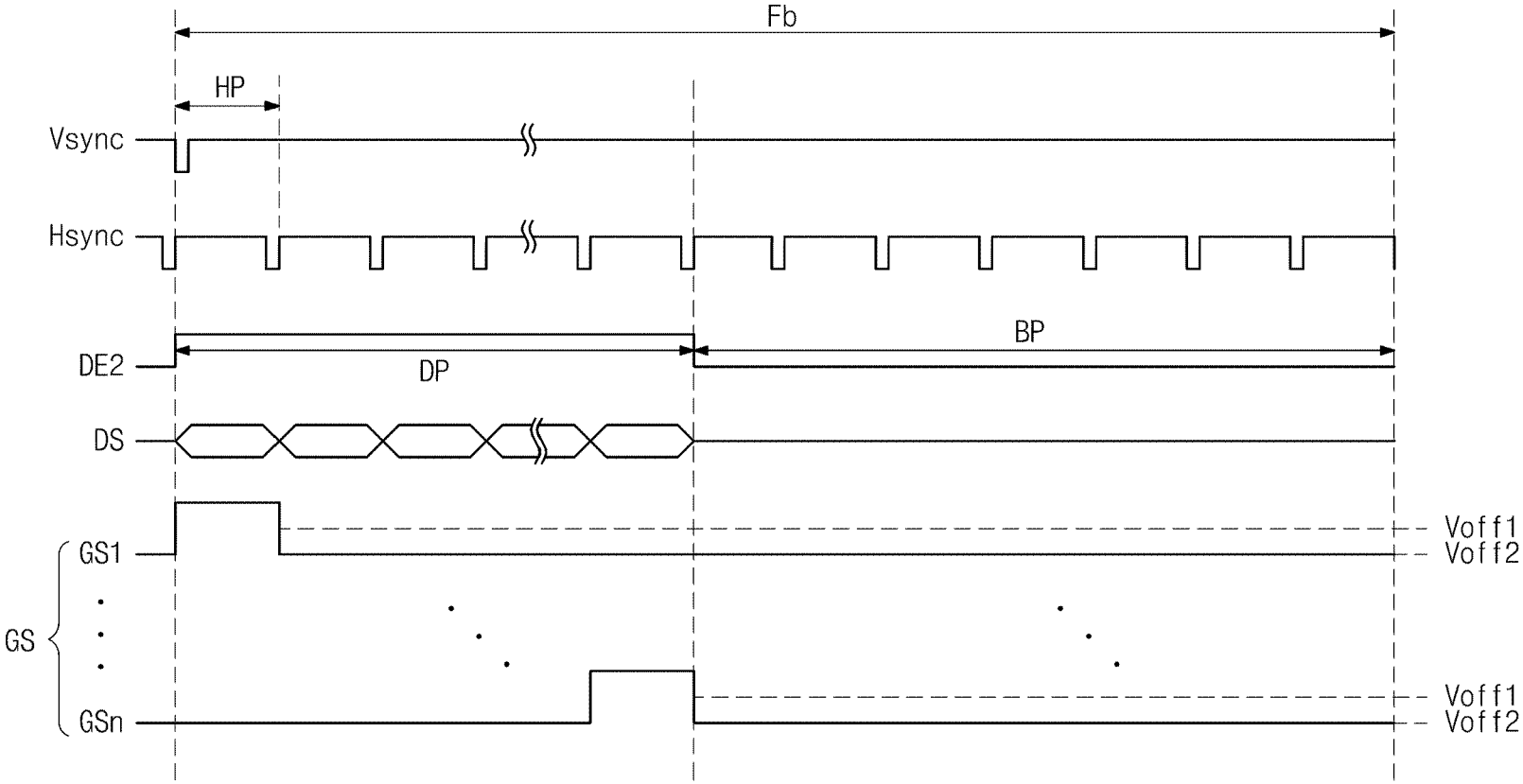
FIG. 4 is a timing diagram illustrating a gate-off voltage based on the second image driving mode illustrated in FIG. 2.

FIG. 3 is a timing diagram illustrating a gate-off voltage based on the first image driving mode illustrated in FIG. 2. FIG. 4 is a timing diagram illustrating a gate-off voltage based on the second image driving mode illustrated in FIG. 2.

Herein, it is assumed that the display device according to FIG. 3 is operated on the basis of a normal frame. Furthermore, it is assumed that the display device according to FIG. 4 is operated on the basis of a low-frequency frame.

Referring to FIGS. 1 and 3, the signal control unit 100 may include a vertical synchronization signal Vsync for differentiating first frame intervals Fa and Fa+1, a signal for differentiating horizontal intervals HP, i.e., a horizontal synchronization signal Hsync that is a row differentiating signal, and a data enable signal DE having a high level only during a data output interval to indicate a data-incoming section.

The vertical synchronization signal Vsync is included in the gate control signal G-CS. The horizontal synchronization signal Hsync and the data enable signal DE are included in the data control signal D-CS. Furthermore, the gate control signal G-CS may include a clock signal and a clock bar signal for generating high-level gate signals GS1 to GSn.

Data voltages DS output from the data driving unit 400 may include positive data voltages having a positive value with respect to a common voltage and/or negative data voltages having a negative value with respect to the common voltage. During each horizontal interval HP, a portion of the data voltages applied to the data lines DL1 to DLm may have a positive polarity, and the other portion may have a negative polarity. The polarities of the data voltages DS may be inverted according to the frame intervals Fa and Fa+1 to prevent deterioration of liquid crystals. In response to an inversion signal, the data driving unit 400 may generate data voltages inverted on the basis of a frame.

The gate driving unit 200 generates the gate signals GS1 to GSn in response to the gate control signal G-CS received from the signal control unit 100, during the frame intervals Fa and Fa+1. The gate driving unit 200 sequentially outputs the gate signals GS1 to GSn to the gate lines GL1 to GLn. The gate signals GS1 to GSn may be sequentially output to correspond to the horizontal intervals HP.

Furthermore, the display panel 500 includes a display interval DP for displaying an image based on a corresponding frame and a black interval BP in which an image is not displayed. Herein, it is assumed that, in the display interval DP, the data voltages DS are output to the data lines DL1 to DLm and the data enable signal DE1 has a high level. Furthermore, it is assumed that, in the blank interval BP, the data voltages DS are not output to the data lines DL1 to DLm and the data enable signal DE1 has a low level.

Referring to FIG. 4, the second frame Fb illustrated in FIG. 4 has a longer duration than that of the first frame Fa illustrated in FIG. 3. In further detail, the display interval DP of the display panel 500 based on the second frame Fb (hereinafter referred to as a second display interval) may be substantially the same as the display interval DP of the display panel 500 based on the first frame Fa (hereinafter referred to as a first display interval). On the contrary, the blank interval BP of the display panel 500 based on the second frame Fb (hereinafter referred to as a second blank interval) may be set to be longer (in duration) than the blank interval BP of the display panel 500 based on the first frame Fa (hereinafter referred to as a first blank interval). That is, a low interval of the data enable signal DE2 illustrated in FIG. 4 may be longer (in duration) than that of the data enable signal DE1 illustrated in FIG. 3.

For example, the second blank interval may be a time that is a sum of the first blank interval and an interval of the first frame Fa. The second frame Fb may correspond to a time (e.g., duration) that is two times longer than that of the first frame Fa.

However, as the second blank interval is long (in duration), the gate signals GS1 to GSn are changed in level due to an external leakage in the second black interval. That is, the gate signals GS1 to GSn provided to the gate lines GL1 to GLn may be temporarily changed in level from a low level to a high level due to the external leakage. As a result, gate terminals of the pixels PX11 to PXnm may be driven.

As described above, each of the gate signals includes the high interval having the first voltage level and the low interval having the second voltage level. According to an embodiment of the present inventive concept, each of the gate signals GS1 to GSn based on the second frame Fb maintains a level of the second gate-off voltage Voff2 lower than that of the first gate-off voltage Voff1 during the low interval. That is, the gate driving unit 200 provides the second gate-off voltage Voff2 to the gate lines GL1 to GLn during the low interval of each of the gate signals GS1 to GSn based on the second frame Fb. As a result, the gate signals GS1 to GSn provided to the gate lines GL1 to GLn may be prevented from being temporarily changed in level from a low level to a high level due to the external leakage.

According to an embodiment of the present inventive concept, the first voltage level of each of the gate signals GS1 to GSn may have a positive polarity and the second voltage level may have a negative polarity. That is, the first and second gate-off voltages Voff1 and Voff2 may have a negative polarity.

According to an embodiment of the present inventive concept, the second gate-off voltage Voff2 may have an opposite polarity and the same or substantially the same magnitude in comparison with the first voltage level during the high interval of each of the gate signals GS1 to GSn.

According to an embodiment of the present inventive concept, the gate voltage generation unit 300 provides the second gate-off voltage Voff2 having a constant or substantially constant level to the gate lines GL1 to GLn during the low interval of each of the gate signals GS1 to GSn based on the second frame Fb.

Figure 6:
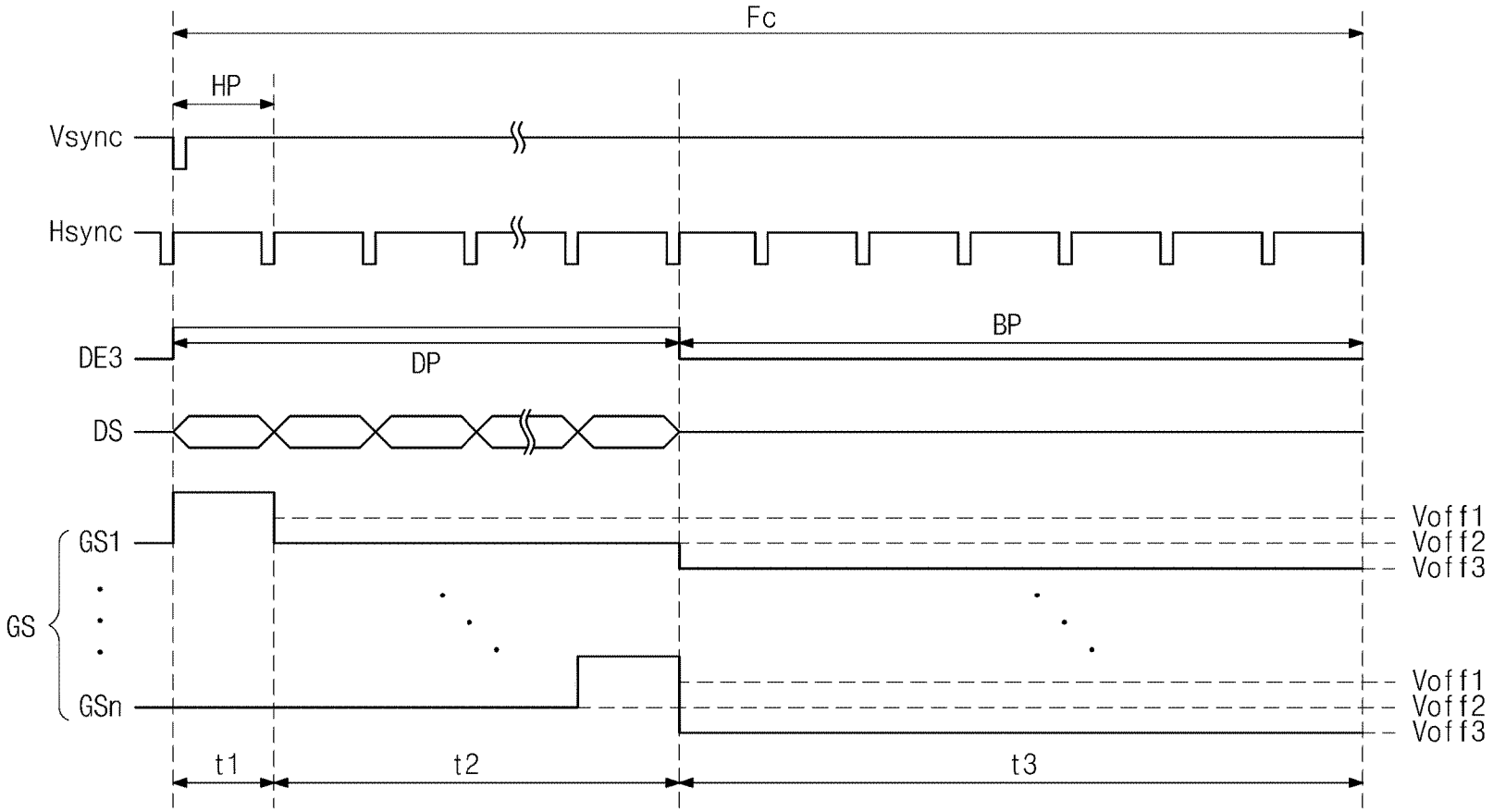
FIGS. 6 to 8 are timing diagrams illustrating a change of a gate-off voltage at the time of low-frequency driving, according to another embodiment of the present inventive concept.
Figure 7:
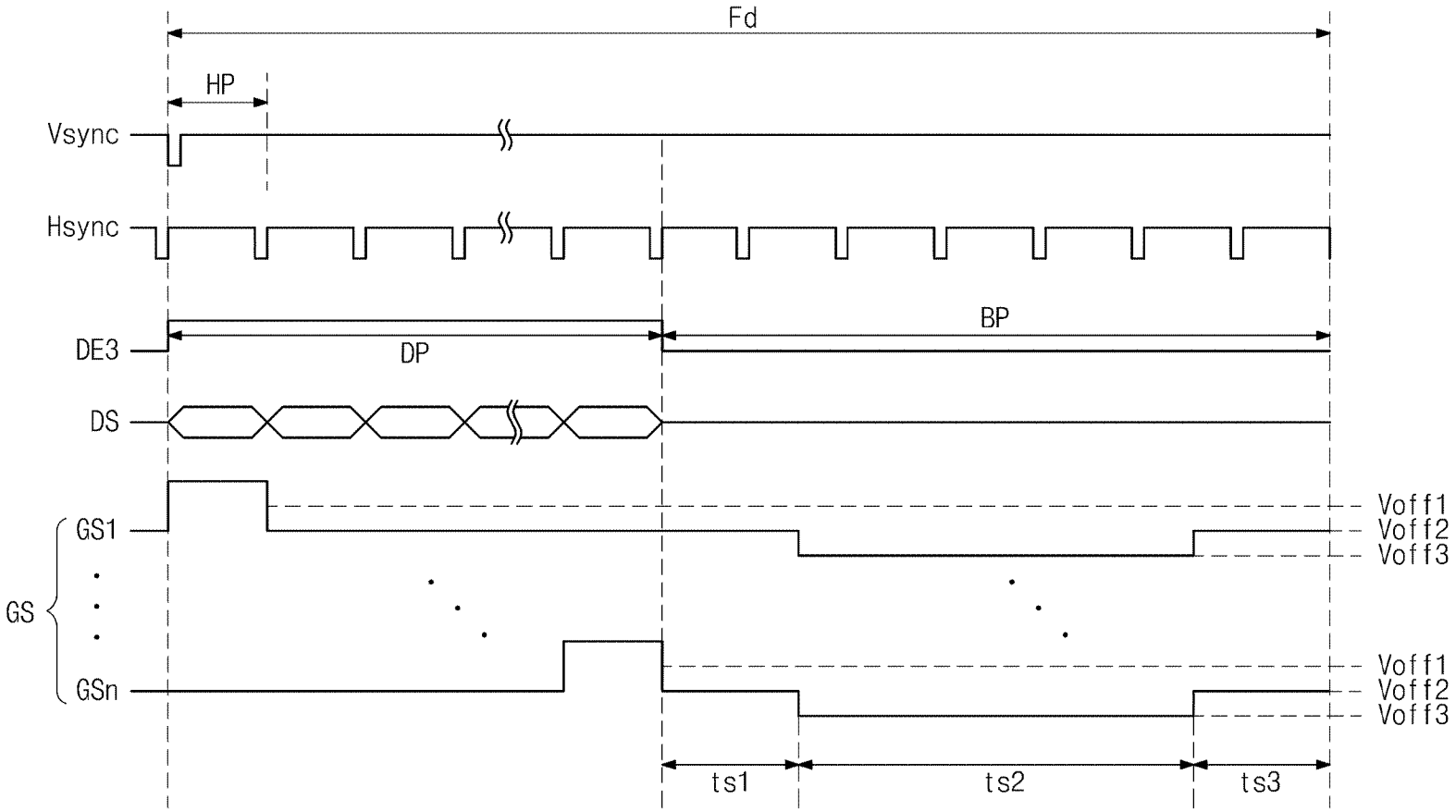
Figure 8:
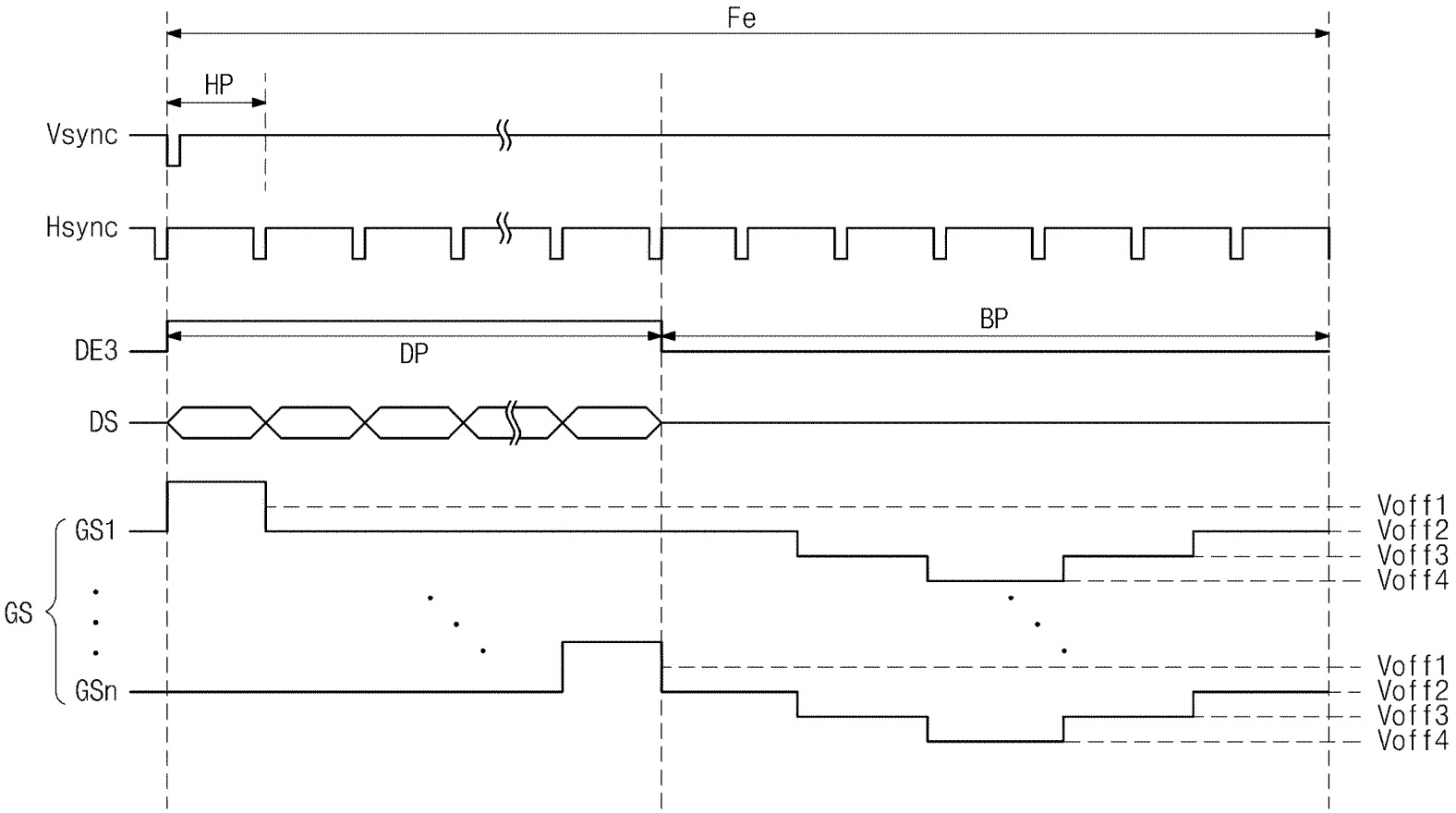

FIG. 5 is a table illustrating a change of a gate-off voltage depending on image signal information, according to another embodiment of the present inventive concept. FIGS. 6 to 8 are timing diagrams illustrating a change of a gate-off voltage at the time of low-frequency driving according to another embodiment of the present inventive concept.

FIGS. 5 to 8 illustrate that the display device is operated in the second image driving mode PS according to the image control signal I-CS. Because the first image driving mode P1 has been described with reference to FIG. 2, the first image driving mode P1 is not described below. An operating method of the display device based on the frames Fc, Fd, and Fe illustrated in FIGS. 6 to 8 may be the same or substantially the same as that of the display device based on the frame Fb illustrated in FIG. 4, except that a level of a gate-off voltage output from the gate voltage generation unit 300 is changed.

That is, times of the third to fifth frames Fc to Fe illustrated in FIGS. 6 to 8 may be equal to the time of the second frame Fb illustrated in FIG. 2.

According to the second image driving mode P2 illustrated in FIG. 5, the gate voltage generation unit 300 may output different first to third gate-off signals Voff1 to Voff3 during the low interval of each of the gate signals GS1 to GSn.

That is, compared to the second image driving mode P2 illustrated in FIG. 2, the second image driving mode P2 illustrated in FIG. 5 may include a plurality of gate-off voltages instead of a single gate-off voltage. The first gate-off voltage Voff1 illustrated in FIG. 6 may have a voltage level corresponding to the low interval of each gate signal, based on a normal frame.

Referring to FIGS. 1 and 6, the third frame Fc includes the display interval DP for displaying an image and the black interval BP in which an image is not displayed. Furthermore, the display interval DP includes a first interval t1 in which each gate signal has a high level and a second interval t2 in which each gate signal has a first low level. Here, the first and second intervals t1 and t2 are merely described on the basis of the first gate signal GS1, and are not limited thereto. The blank interval BP includes a third interval t3 in which each gate signal has a second low level.

In the display interval based on the third frame Fc, each gate signal maintains a level of the second gate-off voltage Voff2 lower than that of the first gate-off voltage Voff1 during the second interval t2. In this case, the gate voltage generation unit 300 outputs the second gate-off voltage Voff2 to the gate lines GL1 to GLn during the display interval DP.

Thereafter, in the blank interval BP based on the third frame Fc, each gate signal maintains a level of the third gate-off voltage Voff3 lower than that of the second gate-off voltage Voff2 during the low interval. Here, the gate-off voltage according to the second and third intervals t2 and t3 maintains a constant or substantially constant voltage level.

The display panel 500 based on the fourth frame Fd illustrated in FIG. 7 may be the same or substantially the same as the display panel 500 based on the third frame Fc illustrated in FIG. 6, except that a gate-off voltage level is changed in the blank interval BP.

In further detail, referring to FIG. 7, the blank interval BP may include first to third sub intervals ts1 to ts3. According to an embodiment of the present inventive concept, in at least one of the first to third sub intervals ts1 to ts3, each of the gate signals GS1 to GSn may have a level of the second gate-off voltage Voff2. For example, in the first and third sub intervals ts1 and ts3, each of the gate signals GS1 to GSn may have a level of the second gate-off voltage Voff2.

Furthermore, in at least one of the first to third sub intervals ts1 to ts3, each of the gate signals GS1 to GSn may have a level of the third gate-off voltage Voff3. For example, in the second sub interval ts2, each of the gate signals GS1 to GSn may have a level of the third gate-off voltage Voff3.

According to the second image driving mode P2 illustrated in FIG. 8, the gate voltage generation unit 300 may output different first to fourth gate-off signals Voff1 to Voff4 during the low interval of each of the gate signals GS1 to GSn.

As described above, the signal control unit 100 may control the level of the gate-off voltage of the gate signals GS1 to GSn on the basis of image information corresponding to frames. That is, the signal control unit 100 performs control so that a low interval level of the gate signals GS1 to GSn is lower at the time of driving for a low-frequency frame than at the time of driving for a normal frame.

According to an embodiment of the present inventive concept, a level of a gate-off voltage may be controlled according to image signal information. As a result, the reliability of overall operation of a display device may be improved.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers'to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The above-disclosed subject matter is to be considered illustrative and not restrictive, and the appended claims are intended to cover all such modifications, enhancements, and other embodiments, which fall within the true spirit and scope of the present inventive concept. Thus, to the maximum extent allowed by law, the scope of the present inventive concept is to be determined by the broadest permissible interpretation of the following claims and their equivalents, and shall not be restricted or limited by the foregoing detailed description.

What is claimed is:

1. A display device comprising:

a gate driver configured to output a plurality of gate signals to a plurality of gate lines during each of a first frame and a second frame; and a display panel configured to display a first image during the first frame and to display a second image during the second frame, the second frame being longer in duration than the first frame, wherein each of the gate signals outputted during each of the first and second frames comprises a high interval having a first voltage level and a low interval having a second voltage level lower than the first voltage level, and wherein the second voltage level of the gate signals during the second frame is lower than the second voltage level of the gate signals during the first frame.

2. The display device of claim 1, wherein each of the gate signals has a positive polarity in the high interval and has a negative polarity in the low interval.

3. The display device of claim 2, wherein the first voltage level and the second voltage level have substantially the same magnitude.

4. The display device of claim 1, further comprising a signal controller configured to generate a driving control signal according to the first and second frames.

5. The display device of claim 4, further comprising a gate voltage generator configured to output, in response to the driving control signal, a first gate-off voltage or a second gate-off voltage lower than the first gate-off voltage to the gate driver.

6. The display device of claim 5, wherein the gate driver is configured to output the gate signals having the second voltage level corresponding to the low interval of the first frame on a basis of the first gate-off voltage, and to output the gate signals having the second voltage level corresponding to the low interval of the second frame based on the second gate-off voltage.

7. The display device of claim 1, wherein the gate signals of the first frame have a constant level during the low interval of the first frame, and wherein the second voltage level of the gate signals of the second frame has a substantially constant level during the low interval of the second frame.

8. The display device of claim 1, wherein the display panel comprises a first display interval during which an image based on the first frame is displayed and a first blank interval during which an image is not displayed, and comprises a second display interval during which an image based on the second frame is displayed, and a second blank interval.

9. The display device of claim 8, wherein the first and second display intervals have substantially the same interval.

10. The display device of claim 9, wherein the second blank interval is longer in duration than the first blank interval.

11. The display device of claim 1, wherein the low interval of each of the gate signals is longer in duration than the high interval.

12. A display device comprising:

a gate driver configured to output a plurality of gate signals to a plurality of gate lines during each of a first frame and a second frame; and a display panel configured to display a first image during the first frame and display a second image during the second frame, the second frame being longer in duration than the first frame, the second frame comprising a display interval during which the second image is displayed and a blank interval during which the second image is not displayed, wherein each of the gate signals of the first frame comprises a first interval having a first voltage level and a second interval having a second voltage level lower than the first voltage level, wherein each of the gate signals of the second frame comprises a third interval having the first voltage level and a fourth interval having a voltage level lower than the first voltage level, and wherein the fourth interval comprises a first sub interval corresponding to the display interval and a second sub interval during which the gate signals are lower than the second voltage level in at least a part of the blank interval.

13. The display device of claim 12, wherein each of the gate signals of the second frame has a third voltage level lower than the second voltage level during the first and second sub intervals.

14. The display device of claim 12, wherein each of the gate signals of the second frame has the second voltage level during the first sub interval, and has a third voltage level lower than the second voltage level in at least a part of the second sub interval.

15. The display device of claim 14, wherein each of the gate signals of the second frame has a fourth voltage level lower than the third voltage level in an other part of the second sub interval.

16. The display device of claim 12, wherein each of the gate signals of the second frame has the second voltage level during the first sub interval, has the second voltage level in a part of the second sub interval, and has a third voltage level lower than the second voltage level in an other part of the second sub interval.

17. The display device of claim 12, wherein the first and third intervals have substantially the same length.

18. The display device of claim 12, wherein the display panel further comprises a display interval during which the first image based on the first frame is displayed and an other blank interval during which the first image is not displayed, and wherein the blank interval of the second frame is longer in duration than the other blank interval of the first frame.

* * * * *